US010838351B2

(12) United States Patent
Lepri

(10) Patent No.: US 10,838,351 B2
(45) Date of Patent: Nov. 17, 2020

(54) METHOD FOR ADAPTING A PRINTER FOR OPERATING WITH TONERS OF DIFFERENT COLORS

(71) Applicant: M.C. SYSTEM S.R.L., Umbertide (IT)

(72) Inventor: Lorenzo Lepri, Umbertide (IT)

(73) Assignee: M.C. SYSTEM S.R.L., Umbertide (IT)

( * ) Notice: Subject to any disclaimer, the term of this patent is extended or adjusted under 35 U.S.C. 154(b) by 0 days.

(21) Appl. No.: 16/099,259

(22) PCT Filed: Jun. 8, 2017

(86) PCT No.: PCT/IT2017/000116
§ 371 (c)(1),
(2) Date: Nov. 6, 2018

(87) PCT Pub. No.: WO2017/216819
PCT Pub. Date: Dec. 21, 2017

(65) Prior Publication Data

US 2019/0155207 A1 May 23, 2019

(30) Foreign Application Priority Data

Jun. 15, 2016 (IT) ..... 102016000061621

(51) Int. Cl.
*G03G 21/16* (2006.01)
*G03G 15/00* (2006.01)
(Continued)

(52) U.S. Cl.
CPC ..... *G03G 21/1652* (2013.01); *G03G 15/0105* (2013.01); *G03G 15/0142* (2013.01);
(Continued)

(58) Field of Classification Search
CPC ..... G03G 2215/0872; G03G 15/0105; G03G 15/80; G03G 2221/163; G03G 2221/1651;
(Continued)

(56) References Cited

U.S. PATENT DOCUMENTS 5,486,899 A * 1/1996 Iimori ..... G03G 15/0863 340/5.8
6,984,144 B1 * 1/2006 Nelson ..... G03G 15/605 439/374
(Continued)

FOREIGN PATENT DOCUMENTS

JP 2008276117 A * 11/2008 ..... G03G 21/1867

OTHER PUBLICATIONS

International Search Report and Written Opinion dated Oct. 6, 2017 for counterpart PCT Application No. PCT/IT2017/000116.

*Primary Examiner* — Joseph S Wong
(74) *Attorney, Agent, or Firm* — Shuttleworth & Ingersoll, PLC; Timothy Klima

(57) ABSTRACT

A method for adapting a printer for operating with more colours, the printer including an inner framework and a dispenser assembly associable with said framework, includes the steps of application of at least one first quick release connector for electric cables at the dispenser assembly; and application of at least one corresponding second quick release connector at the inner framework of the printer.

10 Claims, 9 Drawing Sheets

(51) Int. Cl.
*G03G 21/18* (2006.01)
*G03G 15/01* (2006.01)
*G03G 15/08* (2006.01)

(52) U.S. Cl.
CPC ..... *G03G 15/0877* (2013.01); *G03G 15/0879* (2013.01); *G03G 15/80* (2013.01); *G03G 21/1867* (2013.01); *G03G 2215/0872* (2013.01); *G03G 2221/163* (2013.01); *G03G 2221/166* (2013.01); *G03G 2221/1651* (2013.01); *G03G 2221/1654* (2013.01)

(58) Field of Classification Search
CPC ..... G03G 2221/1654; G03G 2221/166; G03G 21/1652; G03G 21/1867; G03G 15/0142; G03G 15/0877; G03G 15/0879
See application file for complete search history.

(56) References Cited

U.S. PATENT DOCUMENTS

| | | | | |
|---|---|---|---|---|
| 2008/0226312 | A1* | 9/2008 | Mizoguchi | G02B 26/085 399/38 |
| 2013/0343019 | A1 | 12/2013 | Amann et al. | |
| 2014/0348532 | A1* | 11/2014 | Pezdek | G03G 21/16 399/90 |
| 2015/0071675 | A1* | 3/2015 | Suzaki | G03G 15/80 399/90 |
| 2017/0153658 | A1* | 6/2017 | Kasamai | H02P 29/032 |
| 2019/0064730 | A1* | 2/2019 | Masaki | G03G 15/80 |

* cited by examiner

METHOD FOR ADAPTING A PRINTER FOR OPERATING WITH TONERS OF DIFFERENT COLORS

This application is the National Phase of International Application PCT/IT2017/000116 filed Jun. 8, 2017 which designated the U.S.

This application claims priority to Italian Patent Application No. 102016000061621 filed Jun. 15, 2016, which application is incorporated by reference herein.

TECHNICAL FIELD

This invention relates to a method for adapting a printer for operating with more colours. This invention also relates to an inner framework of a printer, to a colour dispenser module and to a printer.

BACKGROUND ART

In the field of digital printing, solutions are known that allow to obtain high quality prints on supports of different compositions and sizes. Amongst the known solutions, for example for office use, there are "multi-function" laser printers that also allow copying and scanning of documents and the sending of faxes. A fundamental feature of such printers is that of guaranteeing high productivity, allowing a high printing speed to be achieved with associated high quality. Such printers use a toner by using an electrostatic roller that is electrically charged in the zones where ink must be added. The toner is an extremely fine powder containing particles of carbon, iron oxides and resin, which is attracted by the roller and, passing through a heater, is fused and pressed onto the paper, thereby constituting the printed text and images.

At the moment, the most common printers use four-colour toner in black, cyan, magenta and yellow.

There are also printers that use toner with special inks, for example, fluorescent inks or inks such as silver, gold and transparent.

Each printer is set up to use a specific toner. Therefore, there are printers, which are the most widely used, that only use the "classic" four-colour toner black, cyan, magenta and yellow, printers that only use four-colour fluorescent toners and printers that only use toner in the colours silver, gold, transparent and a single other colour.

One problem with current printers is that it is not possible to use a different type of toner in a printer already set up for a specific toner.

In fact, to use a different toner in a printer set up for a specific toner, it would be necessary to completely disassemble parts of the printer, including the dispenser module which connects the toner to the drum cartridges, which can only be taken out by a specialised technician and is only done if really necessary in the event of a printer malfunction. Moreover, action of this type takes a considerable amount of time.

Therefore, a user who wants to print with colours other than the classic four would need to have the use of several different printers or would have to have the support technician intervene to completely substitute parts of the printer. Obviously in this latter case, which also involves significant time and cost, it would not then be easy to return the printer to its initial way of operating with other colours.

A further problem of current printers is due to the fact that printers that do not use the classic four colours do not normally produce a large number of printouts, but still consume a considerable amount of ink due to self-adjustment. Therefore, a user who wants to print even just a few printouts with a non-classic colour, for example silver, must use a printer set up for the colours silver, gold and transparent which, even if not used in the printout, are consumed.

DISCLOSURE OF THE INVENTION

The aim of this invention is therefore to overcome the above-mentioned disadvantages.

The invention achieves the aim by means of a method for adapting a printer for operating with more colors having features as disclosed herein.

The main advantage of this invention is the fact that the printer adapted in this way can be used with toners in different colours.

A further advantage is the fact that replacement of the toners does not require intervention by a specialised technician, but it can even be done by the user.

Another advantage of the invention is the fact that replacement is fast, taking just a few minutes.

Moreover, it is possible to easily extract the toner with the least used colours so that they are not consumed by automatic adjustment, and insert it again only if it is needed.

BRIEF DESCRIPTION OF THE DRAWINGS

Further advantages and features of this invention are more apparent in the detailed description which follows, with reference to the accompanying drawings, which illustrate an example of it without limiting the scope of the invention, in which.

DETAILED DESCRIPTION OF PREFERRED EMBODIMENT OF THE INVENTION

Figure 1:
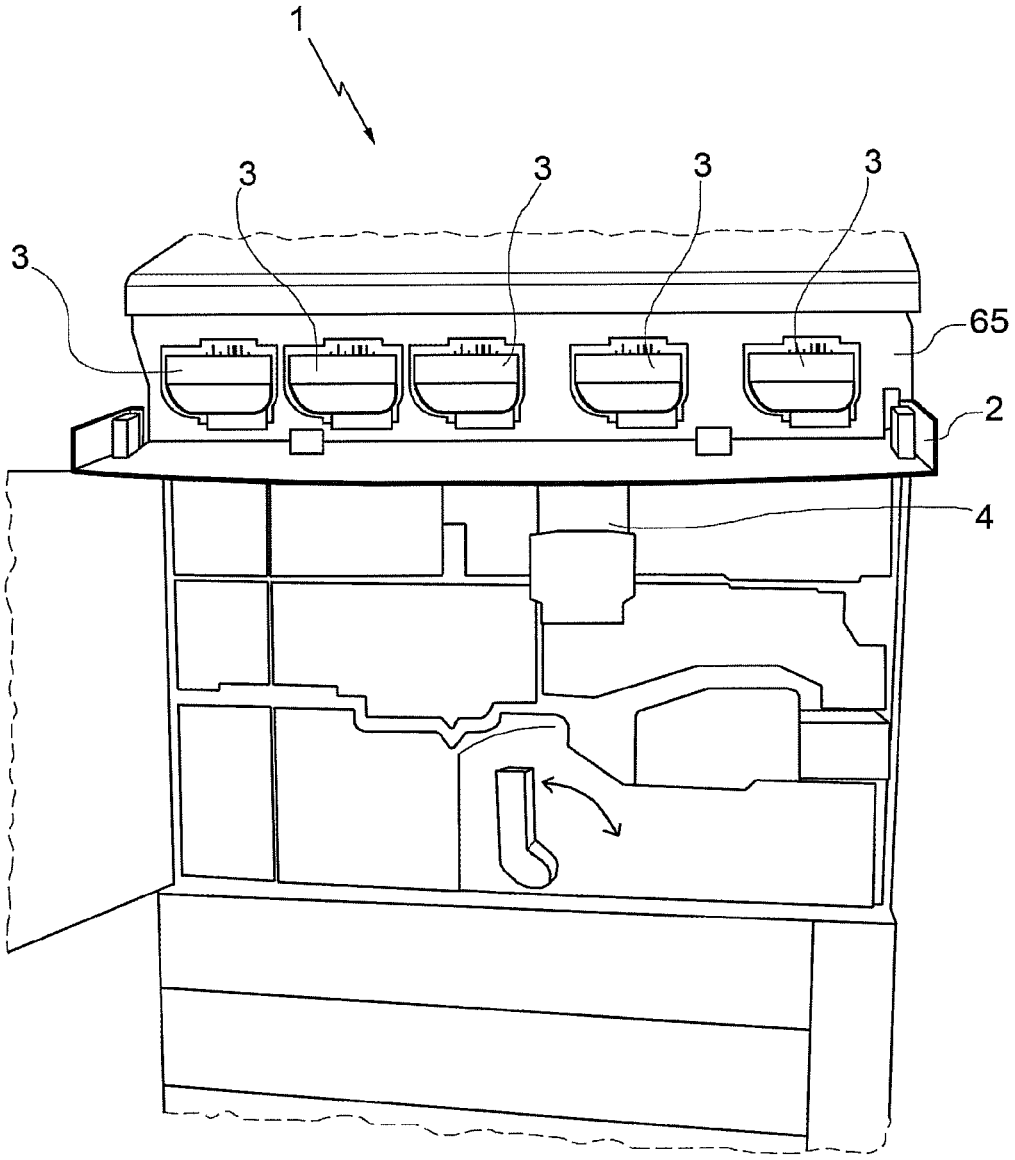
FIG. 1 is a front view of a prior art printer with the front door and the toner cartridge door in the open position

In FIG. 1 the numeral 1 denotes a prior art printer, for example a multi-function laser printer, showing the door 2 that covers the toner cartridges 3 in the open configuration, the toner cartridges, arranged in the upper part of the printer 1, and a housing 4 for drum cartridges 5, which is positioned below the toner cartridges 3.

Figure 2:
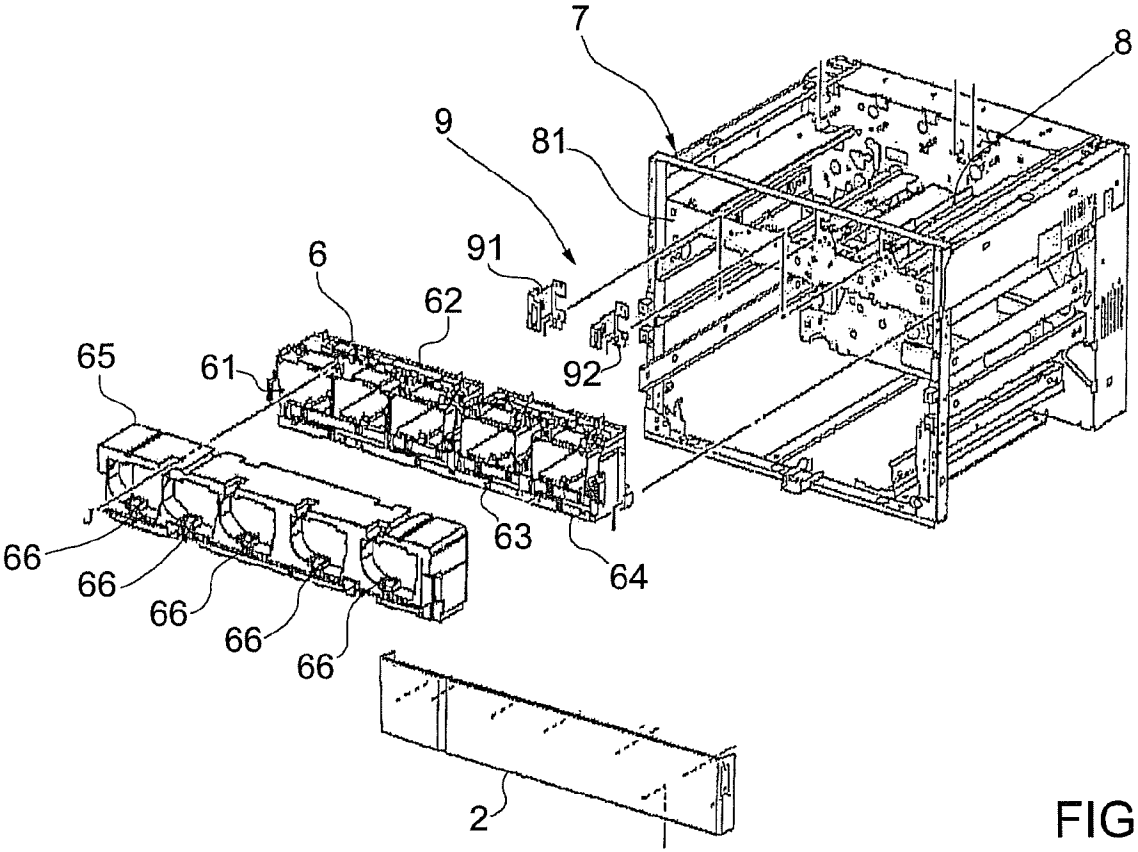
FIG. 2 is an exploded view of a detail of the printer of FIG. 1 with a supporting unit for the toner cartridges and a dispenser assembly

The toner cartridges 3 are inserted in the printer 1 through a dispenser assembly 6 on which a front cover 65 is applied, the latter provided with openings 66 for the passage of the toner cartridges (FIG. 2). The door 2 for covering the toner cartridges 3 is hinged to the front cover 65.

Inside the printer 1 is a framework 7, comprising, in the upper part a support 8 for the toner cartridges 3.

Figure 3:
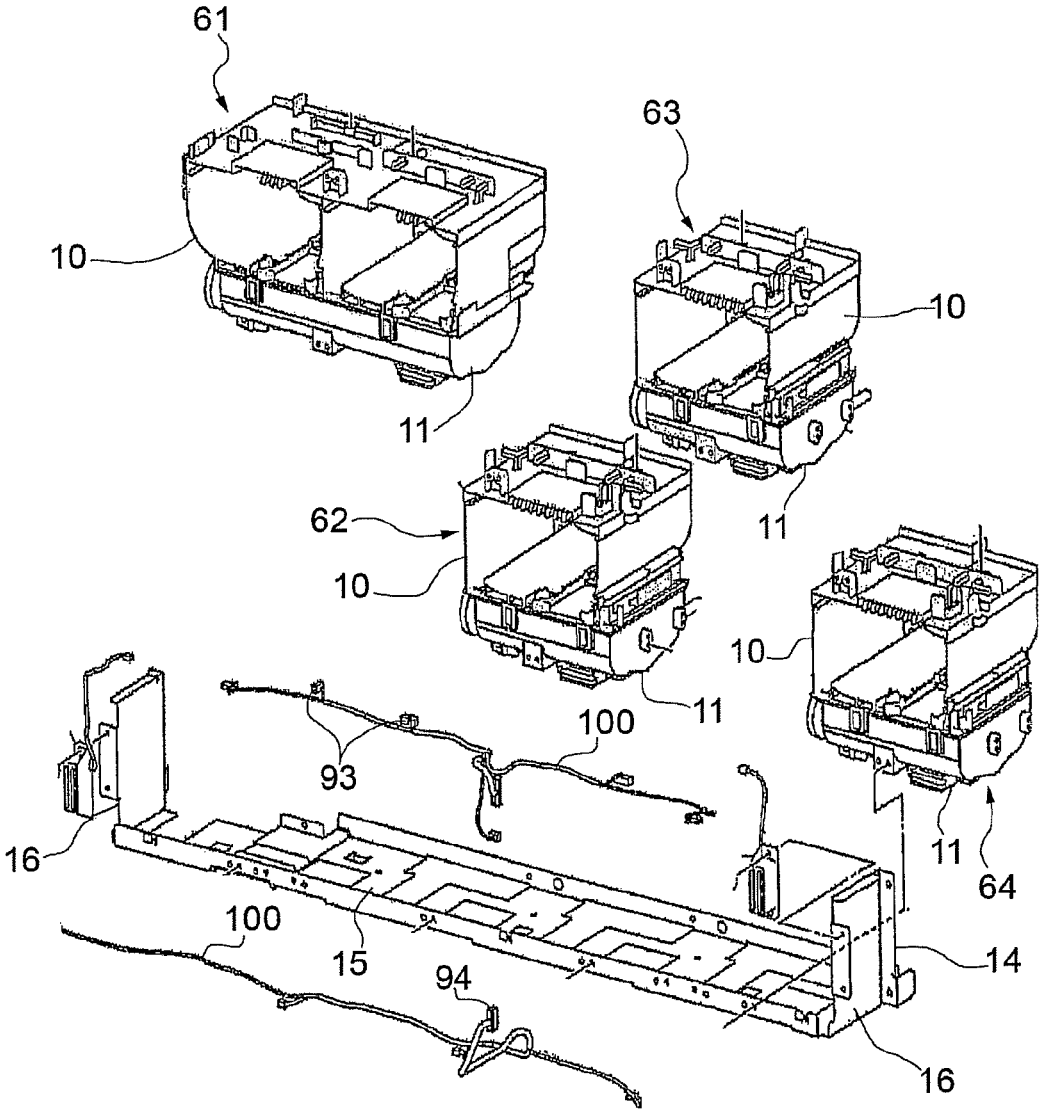
FIG. 3 is a detailed perspective view of the dispenser assembly of the support of FIG. 2

The front zone 81 of the support 8 for toner cartridges 3 comprises hooking means 9, in the case illustrated two hooking brackets 91, 92, for hooking to one or more connectors 93, 94 for electric cables, illustrated in FIG. 3. The electric cables are inserted between the dispenser modules 61, 62, 63, 64, then the connectors 93, 94 are hooked and fixed to the brackets 91, 92.

As illustrated in FIG. 3, each dispenser module 61, 62, 63, 64 comprises a box-shaped containment element 10 equipped with a base 11. One dispenser module 61 is double. The other dispenser modules 62, 63, 64 are single. The dispenser modules 61, 62, 63, 64 are arranged side by side and are inserted in a support 14 comprising a bottom wall 15 and two lateral walls 16. The dispenser assembly 6 is inserted in the printer 1 and is fixed to the framework 7 using screws. The related cover 65 is then fixed to the dispenser assembly 6 using screws.

Figure 4:
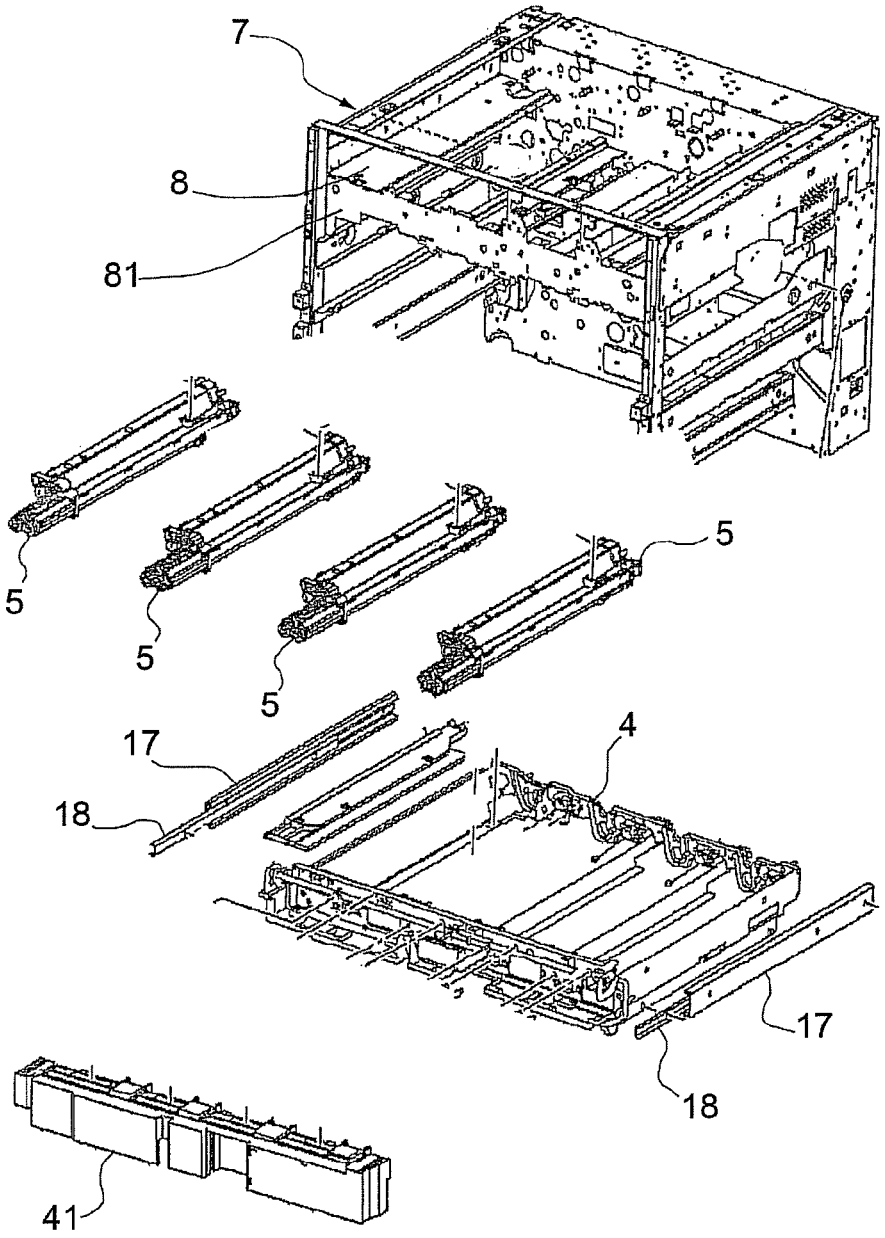
FIG. 4 is an exploded view of a detail of the printer of FIG. 1 with sliding module and drum cartridges

The inner framework 7 of the printer also comprises lateral guides 17 positioned below the support 8 for the toner cartridges 3. Telescopically inserted in the guides 17 there are strips 18 connected to the housing 4 of the drum cartridges 5, as illustrated in FIG. 4, in such a way as to constitute a sliding module. A cover 41 is fixed to the front wall of the housing 4.

In prior art printers, as part of routine maintenance, the user can replace the toner cartridges 3, or the drum cartridges 5 by opening the drum cartridge sliding module and taking out the drum cartridge to be replaced. No other action relative to use of the colour can be performed by the user. In particular, the user has no access to the dispenser modules 61, 62, 63, 64.

In order to remove the dispenser modules 61, 62, 63, 64, an operation that can only be performed by specialised personnel, first the toner cartridges 3 must be removed, then the screws loosened and the door of toner cartridges 2 removed. Then the screws and the inner cover 65 of the dispenser modules 61, 62, 63, 64 must be removed. At this point, the connectors 93, 94 must be disconnected, and both the fixing screws of the dispenser modules 61, 62, 63, 64 and the screws positioned on the right and on the left of the printer intermediate transfer belt must be taken out. Then the handles of the intermediate transfer belt drawer and of the drum cartridge sliding module 5 have to be opened. Then the drum cartridge sliding module 5 must be opened by making it slide to the outside of the printer, and the dispenser assembly 6 lifted and taken out.

According to the invention, the printer in FIG. 1 is modified by acting on the inner framework 7 and on the dispenser assembly 6 in such a way that the dispenser assembly 6 can be rapidly replaced, in order to adapt the printer for operating with more colours.

The method according to the invention comprises the steps of application of at least one first quick release connector 101 for electric cables at the dispenser assembly 6 and application of at least one corresponding second quick release connector 102 for electric cables at the inner framework 7 of the printer (FIGS. 5, 7, 9, 10).

Figure 6:
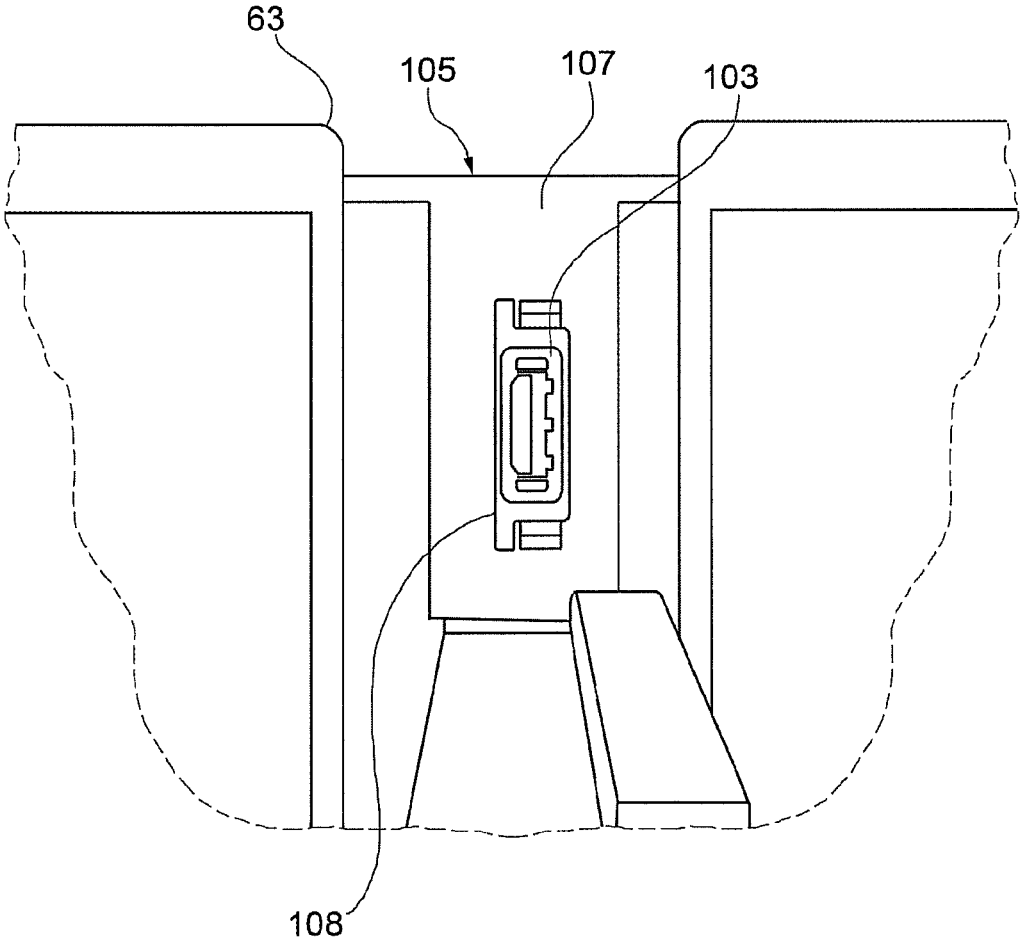
FIG. 6 illustrates another detail of the front portion of the inner framework of the printer modified according to a preferred embodiment of this invention
Figure 7:
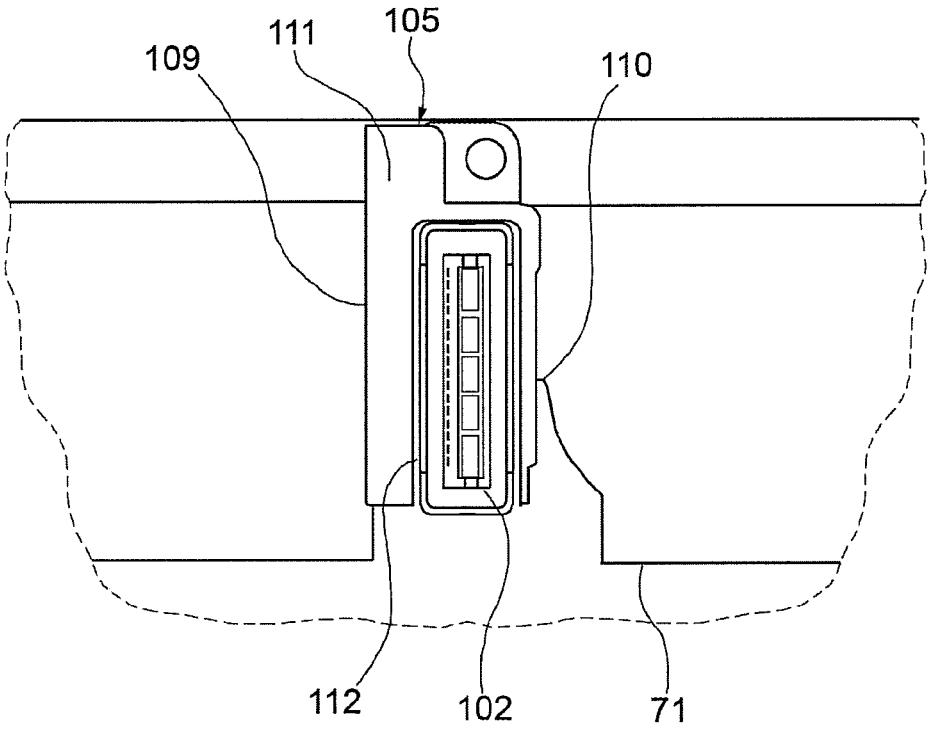
FIG. 7 illustrates a detail of the rear wall of one of the dispenser modules in a preferred embodiment of this invention

Advantageously, the method also comprises a step of removing the hooking means 9 of the inner framework 7 of the printer 1. Moreover, the method preferably comprises a step of replacement of one or more connectors 93, 94 of the electric cables 100 used in the printer 1 illustrated with one or more quick release connectors 101, 103 (FIGS. 3, 6, 7).

In the preferred embodiment illustrated in the figures, a first connector 101 is applied on the rear wall 12 of one of the dispenser modules 61, and the corresponding second connector 102 is applied at the front zone 71 of the framework 7.

In the embodiment illustrated, two quick release connectors 101, 103 are used, which are applied to the dispenser assembly 6, and two corresponding quick release connectors 102, 104 are used, which are applied to the inner framework 7 of the printer at the front zone 71, in particular at the front zone 81 of the support 8 for the toner cartridges 3.

In particular, to fix the connector 101, 103 to the corresponding dispenser module 61, 63, an L-shaped bracket 105 is provided, a first portion 106 of which is fixed to a lateral wall 13 of the dispenser module 61, 63 or of the base 11 of the dispenser module 61, 63 and a second portion 107, provided with an opening 108, is positioned on the rear wall 12 of the dispenser module 61, 63 or of the base 11 of the dispenser module 61, 63, in such a way as to position and support the connector 101, 103.

Similarly, to fix the second connector 102, 104, an L-shaped bracket 105 is provided, a first portion 109 of which is fixed to a supporting element 110 of the front zone 71 of the framework 7 and a second portion 111, provided with an opening 112, is positioned on the front zone 71 of the framework 7, in such a way as to position and support the connector 102, 104.

Figure 5:
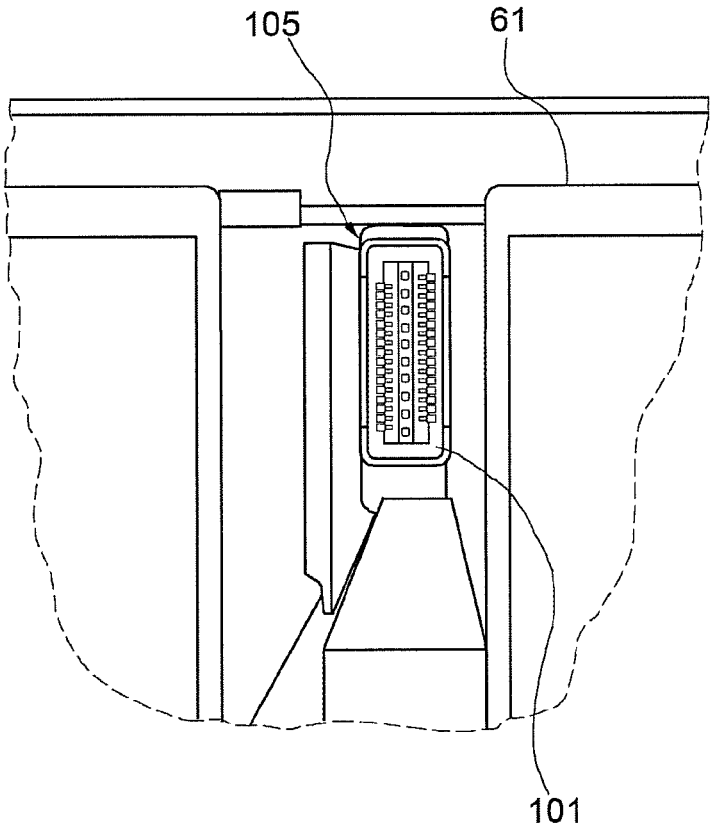
FIG. 5 illustrates a detail of the front portion of the inner framework of the printer modified according to a preferred embodiment of this invention

FIG. 5 illustrates a detail of the rear wall 12 of the base 11 of a dispenser module 61 on which a female quick release connector 101 is fixed, for example of the 16-pin type. In the embodiment illustrated the connector 101 is between the double dispenser module 61 and the adjacent dispenser module 62, and it replaces the connector 93 of FIG. 3.

Similarly, FIG. 6 illustrates a detail of the rear wall 12 of the base 11 of another dispenser module 63 on which a female quick release connector 103 is fixed, for example of the 16-pin type. In the embodiment illustrated the connector 103 is between the other two dispenser modules 63, 64 and substitutes the connector 94 of FIG. 3.

FIG. 7 illustrates a detail of the front zone 71 of the inner framework 7 of the printer on which a male quick release connector 102 is fixed, for example of the 16-pin type. In the embodiment illustrated the connector 102 is at the corresponding connector 101 positioned between the double dispenser module 61 and the adjacent dispenser module 62, and it substitutes the bracket 91 of FIG. 3.

Figure 8:
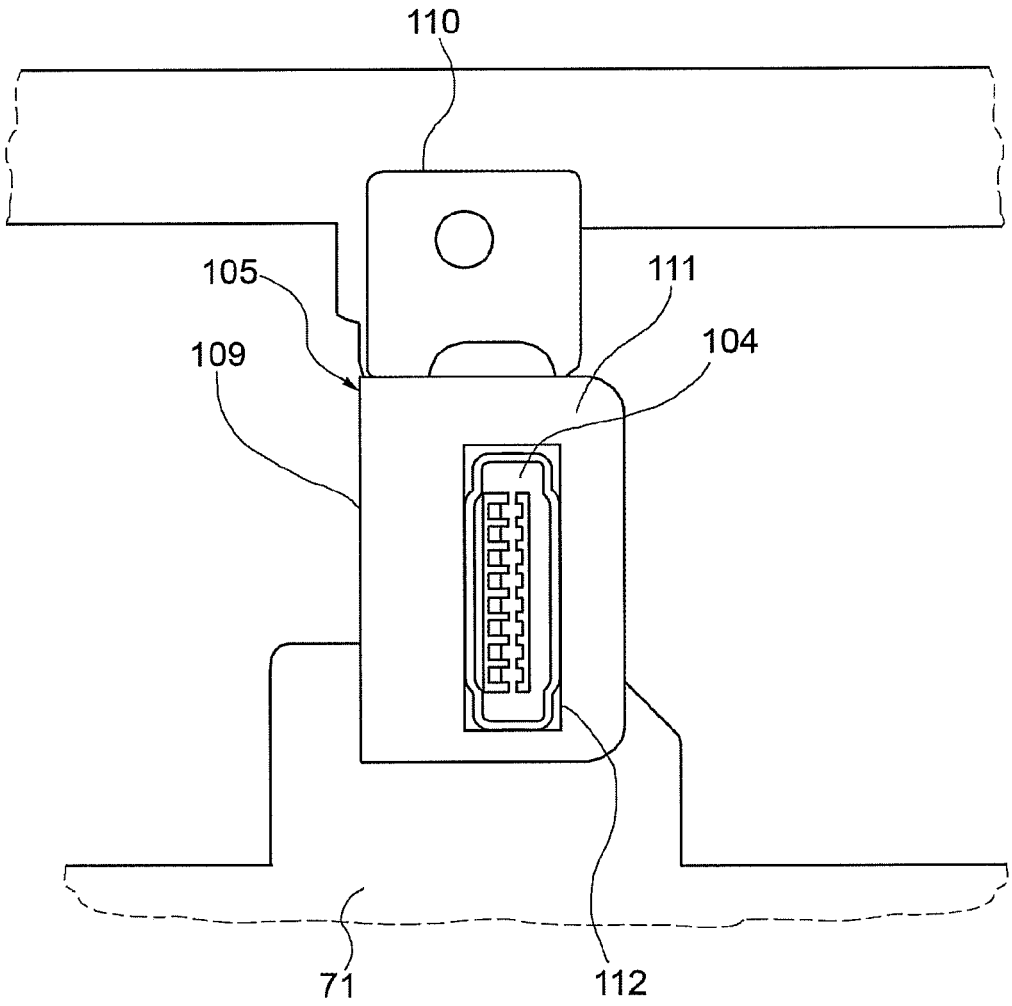
FIG. 8 illustrates a detail of the rear wall of another dispenser module in a preferred embodiment of this invention

Similarly, FIG. 8 illustrates a detail of the front zone 71 of the inner framework 7 of the printer on which a male quick release connector 104 is fixed, for example of the 16-pin type. In the embodiment illustrated the connector 104 is arranged at the corresponding connector 102, which is positioned between the other two dispenser modules 63, 64, and it substitutes the bracket 92 of FIG. 3.

Preferably, the method comprises a step of application of at least one magnet 19 in a front zone 71 of the framework 7 at the dispenser assembly 6, having a metal structure. In particular, the magnet 19 is applied on the front part of a frame 72 of the framework 7. Advantageously, a pair of magnets 20, 21, for example neodymium magnets, is applied on the right part and on the left part of the front frame 72.

In this way, it is no longer necessary to use screws for fixing the dispenser assembly to the framework, therefore making replacement of the assembly quicker and easier.

Figure 9:
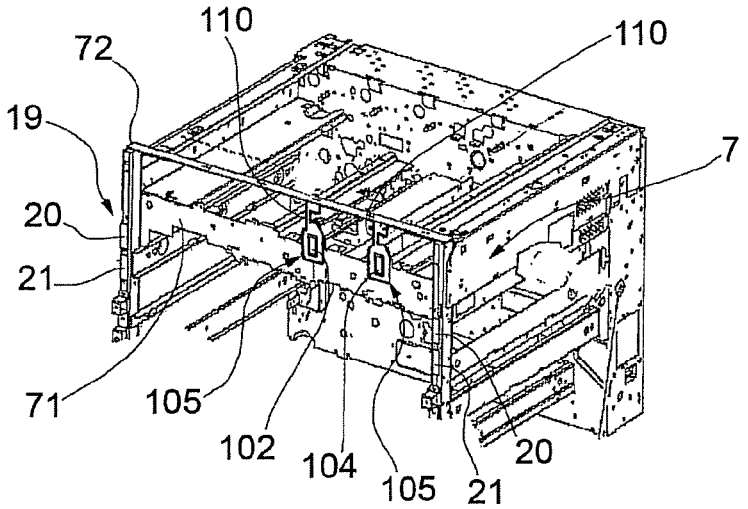
FIG. 9 illustrates the inner framework of a printer modified according to a preferred embodiment of this invention
Figure 10:
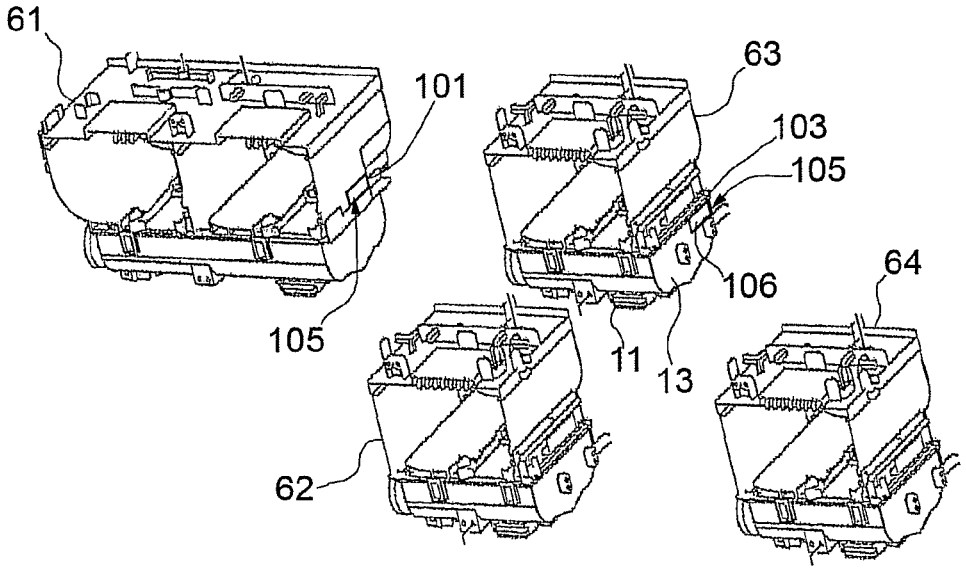
FIG. 10 illustrates the dispenser modules of a printer modified according to a preferred embodiment of this invention.

FIG. 9 illustrates the framework 7 modified with the application of two pairs of magnets 20, 21 and the quick release connectors 102, 104. FIG. 10 illustrates the dispenser modules 61, 62, 63, 64 and the quick release connectors 101, 103 applied on the first dispenser module 61 and on the third dispenser module 63 by means of the brackets 105.

In the printer adapted according to the method disclosed herein, it is therefore possible to use different inks by substituting the toner cartridges 3, the drum cartridges 5 and the dispenser modules 61, 62, 63, 64 quickly and easily.

Starting from printer operation with the standard four colours and if the user wants to use, for example, fluorescent inks, the user must open the drum cartridge sliding module 5, open the door 2 of the toner cartridges 3 and take out the toner cartridges 3. Then, without the intervention of a specialised technician, the user can remove the dispenser assembly 6 by simply detaching it from the magnets 20, 21 and from the connectors 102, 104 that are fixed to the framework 7, replace it with a suitable dispenser assembly 6 for fluorescent inks by inserting the assembly 6 in the framework 7 and applying pressure so that the connectors 101, 103 positioned on the dispenser assembly 6 are coupled to the corresponding connectors 102, 104 positioned on the framework 7 and so that the dispenser assembly 6 stably adheres to the magnets 20, 21. At this point, the user just has to replace the toner cartridges 3 and the drum cartridges 5 in the sliding module and then close the sliding module again to allow the printer to operate with the new toners. The operation is similar if substituting fluorescent toners with gold, silver and transparent inks.

The invention claimed is:

1. A method for adapting a printer for operating with toners of different colors, comprising:

providing that the printer comprises an inner framework, toner cartridges, drum cartridges, and a dispenser assembly associable with the inner framework and connecting the toner cartridges to the drum cartridges, wherein the dispenser assembly comprises a module including a box-shaped containment element and, wherein the toner cartridges are insertable in the printer through the dispenser assembly;

fixing a first plug/socket quick release connector for electric cables to an outer wall of the box-shaped containment element of the dispenser assembly;

fixing a corresponding second plug/socket quick release connector to the inner framework of the printer at a front zone of the inner framework;

wherein the first plug/socket quick release connector is suitable for coupling to the second plug/socket quick release connector to connect the dispenser assembly to the inner framework.

2. The method according to claim 1, wherein at least one chosen from the first plug/socket quick release connector and the second plug/socket quick release connector is fixed by a bracket.

3. The method according to claim 1, wherein at least one chosen from the first plug/socket quick release connector and the second plug/socket quick release connector is a 16-pin connector.

4. The method according to claim 1, and further comprising a step of fixing at least one magnet in a front zone of the inner framework at the dispenser assembly.

5. The method according to claim 4, wherein the at least one magnet includes a pair of magnets.

6. A dispenser module for a dispenser assembly for connecting toner cartridges to drum cartridges in a printer, comprising:

a box-shaped containment element, a plug/socket quick release connector positioned on an outer wall and suitable for connecting to a corresponding plug/socket quick release connector positioned on an inner framework of the printer.

7. A printer comprising:

an inner framework;

toner cartridges;

drum cartridges;

a dispenser assembly associable with the inner framework and connecting the toner cartridges to the drum cartridges, wherein the dispenser assembly comprises a dispenser module;

wherein the toner cartridges are inserted in the printer through the dispenser assembly;

wherein the inner framework comprises a plug/socket quick release connector positioned at a front zone of the inner framework;

the dispenser module comprising:

a box-shaped containment element, a plug/socket quick release connector positioned on an outer wall of the box-shaped containment element and configured for connecting to the corresponding plug/socket quick release connector positioned at the front zone of the inner framework.

8. The method according to claim 4, wherein the at least one magnet includes a pair of neodymium magnets.

9. The printer according to claim 7, comprising at least one magnet positioned at the front zone of the inner framework.

10. The printer according to claim 9, wherein the at least one magnet includes a pair of neodymium magnets.

* * * * *